US005153087A

United States Patent [19]

Tamura et al.

[11] Patent Number: 5,153,087

[45] Date of Patent: Oct. 6, 1992

[54] ELECTROPHOTOGRAPHIC ELEMENT WITH ACRYLIC ANILIDE POLYMER LAYER

[75] Inventors: Hiroshi Tamura; Reiko Tanaka, both of Numazu, Japan

[73] Assignee: Ricoh Company, Ltd., Tokyo, Japan

[21] Appl. No.: 507,407

[22] Filed: Apr. 11, 1990

[30] Foreign Application Priority Data

May 8, 1989 [JP] Japan ..... 1-115389

[51] Int. Cl.[5] ..... G03G 5/14

[52] U.S. Cl. ..... 430/64; 430/65; 526/305

[58] Field of Search ..... 430/64; 526/305

[56] References Cited

U.S. PATENT DOCUMENTS 2,584,968 2/1952 Catlin ..... 526/305
2,790,789 4/1957 Miller ..... 526/305 X
4,664,995 5/1987 Horgow et al. ..... 430/64 X

*Primary Examiner*—Roland Martin
*Attorney, Agent, or Firm*—Oblon, Spivak, McClelland, Maier & Neustadt

[57] ABSTRACT

An electrophotographic photoconductor comprises least a photoconductive layer and a charge-injection controlling layer, which are overlaid on an electroconductive support in any order, which charge-injection controlling layer comprises a homopolymer or copolymer of a monomer represented by formula (I):

(I)

wherein $R^1$ represents hydrogen or a methyl group; $R^2$ represents hydrogen, an alkyl group having 1 to 4 carbon atoms, a hydroalkyl group having 1 to 4 carbon atoms, an aryl group which may have a substituent, and an aralkyl group which may have a substituent; and $R^3$, $R^4$, $R^5$, $R^6$ and $R^7$ each represent hydrogen, an alkyl group having 1 to 4 carbon atoms, an alkoxy group having 1 to 4 carbon atoms, a hydroxyl group, a nitro group, a nitroso group, a cyano group, a carboxyl group, an alkoxycarbonyl group, an acyl group, a sulfonyl group, an amino group which may have a substituent, a halogen or a trifluoromethyl group.

21 Claims, No Drawings

ELECTROPHOTOGRAPHIC ELEMENT WITH ACRYLIC ANILIDE POLYMER LAYER

BACKGROUND OF THE INVENTION

1. Field of the Invention

The present invention relates to an improved electrophotographic photoconductor comprising a photoconductive layer and a charge-injection controlling layer which are formed on an electroconductive layer.

2. Discussion of Background

In the case of an electrophotographic photoconductor comprising a two-layered photoconductive layer consisting of a charge generation layer and a charge transport layer, which are formed on an electroconductive support, copying operation is performed in the following manner:

The surface of the photoconductor is uniformly charged in the dark to a predetermined polarity by a corona charger; the uniformly charged photoconductor is exposed to a light image so that a latent electrostatic image is formed on the photoconductor; the thus formed latent electrostatic image is developed to a visible toner image by a developer comprising an electrically charged toner; and the developed image can be transferred to a transfer sheet when necessary.

In the above copying operation, occasionally it happens that white spots appear in the developed toner images which are transferred to a transfer sheet.

More specifically, in the case of normal development, a latent electrostatic image formed on a photoconductor is developed to a visible toner image by a toner which is electrically charged to an opposite polarity to that of a latent electrostatic image formed on the photoconductor. In this case, such white spots have a diameter of about 0.1 mm to several mm, in which no toner particles are deposited within a black solid image area.

In the case of reversal development, in which a latent electrostatic latent image formed on the photoconductor is developed with a toner which is electrically charged to the same polarity as that of the latent electrostatic image on the photoconductor, and toner particles are deposited in the shape of a spot having a diameter of 1 mm to several mm in an area where no toner particles should be deposited.

The above-mentioned abnormal spots on the transfer sheet often appear particularly when the image formation and copying process comprising a series of steps, such as charging, exposure, development and image transfer, is repeated. As the image formation and copying process is repeated, the occurrence of such spots becomes more frequent, the number and size of the spots increase. Some photoconductors suffer from the occurrence of such abnormal spots from the initial stage of the image formation and copying process.

As a matter of course, the above-mentioned abnormal spots on the transfer sheet significantly degrade the copying and printing quality when image formation is performed in electrophotographic copying machine, printer and facsimile apparatus.

It is considered that the appearance of such abnormal spots on the transfer sheet results from, for example, local injection of electrical charge into the photoconductive layer from the electroconductive support of the photoconductor. More specifically, when the photoconductor is electrically charged by a corona charger, the surface of the photoconductive layer is charged to a predetermined potential. However, when an electric charge having a polarity opposite to that of the electric charge on the surface of the photoconductive layer is injected into the photoconductive layer from the electroconductive support of the photoconductor, the electric potential of the charge-injected portion is locally decreased. As a result, the photoconductive layer is not uniformly charged and a latent electrostatic image formed on the photoconductive layer cannot be developed to a uniform visible toner image.

In order to prevent the injection of electric charges into the photoconductive layer from the electroconductive support, it has been proposed to provide an intermediate layer between the electroconductive support and the photoconductive layer.

For example, an intermediate layer made of a cellulose nitrate resin is disclosed in Japanese Laid-Open Patent Applications 47-6341, 48-3544 and 48-12034; an intermediate layer made of a nylon resin in Japanese Laid-Open Patent Applications 48-47344, 52-25638, 58-30757, 58-63945, 58-95351, 58-98739 and 60-66258; an intermediate layer made of a vinyl acetate resin in Japanese Laid-Open Patent Application 48-26141; an intermediate layer made of a maleic acid resin in Japanese Laid-Open Patent Applications 49-69332 and 52-10138; and an intermediate layer made of a polyvinyl alcohol resin in Japanese Laid-Open Patent Application 58-105155.

The appearance of abnormal spots on the transfer sheet is in fact decreased when a photoconductor comprising any of the above-mentioned intermediate layers is used, as compared with a photoconductor without such an intermediate layer. Thus it is considered that such intermediate layers have a function of decreasing the occurrence of such abnormal spots. The above-mentioned conventional intermediate layers, however, decrease the photosensitivity of the photoconductor, and the residual potential on the photoconductor is built up as the image formation and copying process is repeated. In addition to the above, the above-mentioned conventional resin-based intermediate layers are susceptible to the moisture contained in the air, so that the residual potential on the photoconductor is apt to increase particularly under the conditions of low temperature and low humidity. This is accompanied by deposition of toner particles on the background of the transfer sheet when the development is performed by use of a toner which is electrically charged to an opposite polarity to that of a latent electrostatic image to be developed.

SUMMARY OF THE INVENTION

Accordingly, an object of the present invention is to provide an improved electrophotographic photoconductor which exhibits stable electrical characteristics, free from the problems of (i) the increase in the residual potential thereof in the course of repeated image formation and copying process, even when the environmental conditions including temperature and humidity change, and (ii) the occurrence of abnormal image formation including the formation of spots in image areas and toner deposition in non-image areas.

The above-mentioned object of the present invention can be achieved by an electrophotographic photoconductor which comprises (i) a photoconductive layer and (ii) a charge-injection controlling layer formed on (iii) an electroconductive support, which charge-injection controlling layer comprises a homopolymer or copolymer obtained by polymerization of a monomer represented by formula (I):

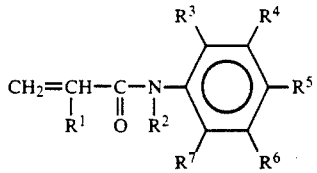

(I)

wherein $R^1$ represents hydrogen or a methyl group; $R^2$ represents hydrogen, an alkyl group having 1 to 4 carbon atoms, a hydroalkyl group having 1 to 4 carbon atoms, an aryl group which may have a substituent, and an aralkyl group which may have a substituent; and $R^3$, $R^4$, $R^5$, $R^6$ and each represent hydrogen, an alkyl group having 1 to 4 carbon atoms, an alkoxyl group having 1 to 4 carbon atoms, a hydroxyl group, a nitro group, a nitroso group, a cyano group, a carboxyl group, an alkoxycarbonyl group, an acyl group, a sulfonyl group, an amino group which may have a substituent, a halogen or a trifluoromethyl group.

DESCRIPTION OF THE PREFERRED EMBODIMENTS

The electrophotographic photoconductor according to the present invention comprises (i) a photoconductive layer and (ii) a charge-injection controlling layer which are formed on (iii) an electroconductive support. In the present invention, the photoconductive layer and the charge-injection layer may be overlaid on the electroconductive support in any order.

As mentioned previously, the charge-injection controlling layer comprises a homopolymer or copolymer obtained by polymerization of a monomer represented by formula (I):

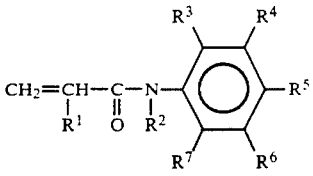

(I)

wherein $R^1$ represents hydrogen or a methyl group; $R^2$ represents hydrogen, an alkyl group having 1 to 4 carbon atoms, a hydroalkyl group having 1 to 4 carbon atoms, an aryl group which may have a substituent, and an aralkyl group which may have a substituent; and $R^3$, $R^4$, $R^5$, $R^6$ and $R^7$ each represent hydrogen, an alkyl group having 1 to 4 carbon atoms, an alkoxyl group having 1 to 4 carbon atoms, a hydroxyl group, a nitro group, a nitroso group, a cyano group, a carboxyl group, an alkoxycarbonyl group, an acyl group, a sulfonyl group, an amino group which may have a substituent, a halogen or a trifluoromethyl group.

The above-mentioned homopolymer of the monomer having formula (I) or copolymer of the monomers having formula (I) for use in the charge-injection controlling layer of the photoconductor according to the present invention is prepared by polymerizing at least one monomer of formula (I) in a solvent in the presence of a polymerization initiator such as azobisisobutyronitrile.

Examples of the solvent used in the course of polymerization of the monomer of formula (I) are ketone-type solvents such as methyl ethyl ketone, methyl isobutyl ketone and cyclohexanone; ester-type solvents such as ethyl acetate and butyl acetate; ether-type solvents such as dioxane and tetrahydrofuran; cellosolve-type solvents such as methyl cellosolve and ethyl cellosolve; alcohol-type solvents such as methanol and ethanol; and amide-type solvents such as dimethylformamide (DMF), dimethyl sulfoxide (DMSO) and methylpyrrolidone.

The monomer having formula (I) can be prepared by allowing an acrylic acid derivative such as acrylyl chloride and methacrylyl chloride to react with a derivative of aniline in an appropriate solvent such as dioxane.

Representative examples of the monomer represented by formula (I) are shown in Table 1.

TABLE 1

| Monomer No. | $R^1$ | $R^2$ | $CH_2{=}C(R^1){-}C(=O){-}N(R^2){-}A$ A | Melting Point (°C.) | IR —NH $\nu$ cm$^{-1}$ | IR —C=O $\nu$ cm$^{-1}$ | IR —CH=CH$_2$ $\delta$ cm$^{-1}$ |
|---|---|---|---|---|---|---|---|
| 1 | H | H | 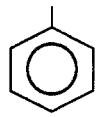 | 104.5~105 | 3300 | 1670 | 990 |
| 2 | H | H | 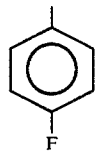 | 101.5~102.5 | 3300 | 1670 | 990 |
| 3 | H | H | 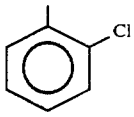 | 100~100.5 | 3220 | 1660 | 990 |

TABLE 1-continued
| Monomer No. | $R^1$ | $R^2$ | $CH_2{=}C(R^1){-}C({=}O){-}N(R^2){-}A$ A | Melting Point (°C.) | IR —NH ν $cm^{-1}$ | IR —C=O ν $cm^{-1}$ | IR —CH=$CH_2$ δ $cm^{-1}$ |
|---|---|---|---|---|---|---|---|
| 4 | H | H | 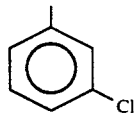 | 107~107.5 | 3280 | 1670 | 980 |
| 5 | H | H | 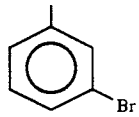 | 122~123.5 | 3300 | 1665 | 980 |
| 6 | H | H | 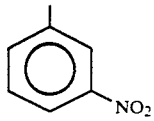 | 153.5~154.5 | 3300 | 1675 | 980 |
| 7 | H | H | 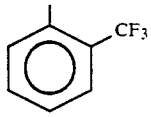 | 115.5~116.5 | 3260 | 1665 | 995 |
| 8 | H | H | 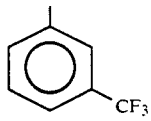 | 86.5~87 | 3330 | 1670 | 980 |
| 9 | H | H | 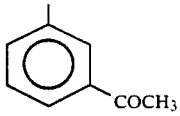 | 113.5~114 | 3330 | 1680 | 985 |
| 10 | H | H | 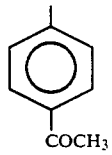 | 150~150.5 | 3320 | 1675 | 990 |
| 11 | H | H | 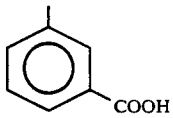 | 240~242 | 3280 | 1690 | 985 |
| 12 | H | H | 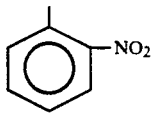 | 89~90 | 3400 | 1710 | 970 |
| 13 | H | H | 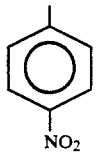 | 233~234 | 3300 | 1675 | 985 |

TABLE 1-continued
| Monomer No. | $R^1$ | $R^2$ | $CH_2{=}C(R^1)-C(=O)-N(R^2)-A$ A | Melting Point (°C.) | IR —NH $\nu$ cm$^{-1}$ | IR —C=O $\nu$ cm$^{-1}$ | IR —CH=CH$_2$ $\delta$ cm$^{-1}$ |
|---|---|---|---|---|---|---|---|
| 14 | H | H | 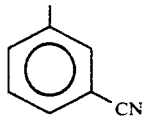 | 119~119.5 | 3260 | 1650 | 990 |
| 15 | H | H | 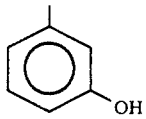 | 164~165 | 3320 | 1660 | 975 |
| 16 | H | H | 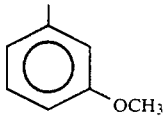 | 105.5 | 3300 | 1670 | 990 |
| 17 | H | H | 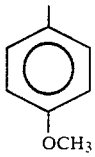 | 98.5~99 | 3320 | 1662 | 990 |
| 18 | H | H | 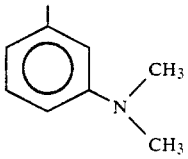 | 103.5~104 | 3300 | 1662 | 900 |
| 19 | H | H | 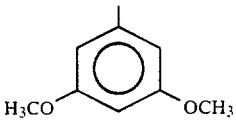 | 103.5~104.5 | 3300 | 1662 | 900 |
| 20 | H | H | 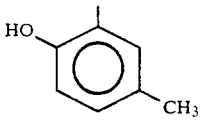 | 104.5~105.5 | 3280 | 1660 | 970 |
| 21 | H | H | 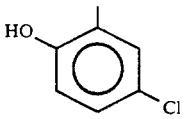 | 167~167.2 | 3410 | 1670 | 980 |
| 22 | H | H | 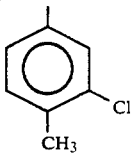 | 123.5~124 | 3300 | 1670 | 990 |
| 23 | H | H | 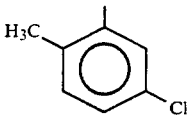 | 147.5~148 | 3300 | 1662 | 990 |

TABLE 1-continued

| Monomer No. | $R^1$ | $R^2$ | $CH_2=C(R^1)-C(=O)-N(R^2)-A$ A | Melting Point (°C.) | IR —NH ν $cm^{-1}$ | IR —C=O ν $cm^{-1}$ | IR —CH=$CH_2$ δ $cm^{-1}$ |
|---|---|---|---|---|---|---|---|
| 24 | H | H | 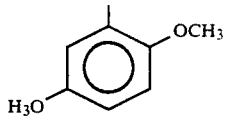 | 101~101.5 | 3210 | 1660 | 990 |
| 25 | H | H | 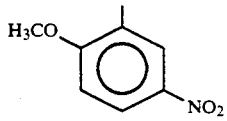 | 137.5~139 | 3350 | 1675 | 990 |
| 26 | H | H | 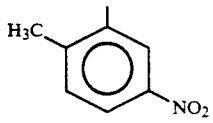 | 178~179 | 3260 | 1660 | 985 |
| 27 | H | H | 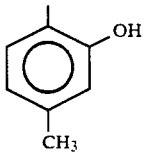 | 130.5~131 | 3260 | 1658 | 985 |
| 28 | H | $CH_3$ | 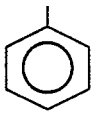 | 76.2~77 | — | 1665 | 990 |

In the charge-injection controlling layer of the photoconductor according to the present invention, (i) homopolymers of the monomers as shown in Table 1 and (ii) copolymers of the monomers as shown in Table 1 and other monomers which can be polymerized in combination with the monomers as shown in Table 1 can be contained.

In addition to the above-mentioned homopolymer or copolymer of the monomer having formula (I), resins which are conventionally used in such a charge-injection controlling layer may be contained in the charge-injection controlling layer of the photoconductor according to the present invention when necessary.

Examples of such resins for use in the charge-injection controlling layer are thermoplastic resins such as polyester, polycarbonate, polyvinyl butyral, polyamide, polystyrene, polyurethane, polypropylene, polyacrylate and polyvinyl chloride; thermosetting resins such as phenolic resin, melamine resin and epoxy resin; and photo-setting resins.

Those conventional resins may be contained in the charge-injection controlling layer at a ratio of 50 wt. % or less, more preferably 30 wt. % or less, to the total weight of the resionous components in the charge-injection controlling layer.

In the charge-injection controlling layer, finely-divided particles of electroconductive materials such as $SnO_2$ and $Sb_2O_3$ and/or white pigments such as ZnO, ZnS and $TiO_2$ can also be contained.

The charge-injection controlling layer can be formed by coating a coating solution for the charge-injection controlling layer on the electroconductive support or on the photoconductive layer by roll coating, dip coating, spray coating or blade coating, and drying or hardening it at 50° C. to 200° C.

It is preferable that the thickness of the charge-injection controlling layer be in the range of 0.05 to 10 μm, more preferably in the range of 0.2 to 2 μm.

In the photoconductor according to the present invention, either a dispersion-type photoconductive layer or a function-separated two-layered type photoconductive layer can be employed.

More specifically, in the case of the above-mentioned dispersion-type photoconductive layer, a photoconductive layer comprising a charge generating material and a charge transporting material which are dispersed in a binder agent is formed on an electroconductive support or on a charge-injection controlling layer.

When the function-separated two-layered type photoconductive layer is employed, a charge generation layer comprising a charge generating material and a binder agent and a charge transport layer comprising a charge transporting material and a binder agent are overlaid on an electroconductive support or on a charge-injection controlling layer. The overlaying order of the charge generation layer and the charge transport layer may be reversed when the photoconductor is positively charged. To improve the photosensitivity, especially in the positively chargeable photoconductor, the charge transporting material may be contained in the charge generation layer.

Specific examples of the charge generating material for use in the present invention are as follows: organic pigments, such as C.I. Pigment Blue 25 (C.I. 21180), C.I. Pigment Red 41 (C.I. 21200), C.I. Acid Red 52 (C.I. 45100), and C.I. Basic Red 3 (C.I. 45210), a phthalocyanine pigment, azulenium pigment, a squaric pigment, an azo pigment having a carbazole skeleton (Japanese Laid-Open Patent Application 53-95033), an azo pigment having a stilstilbene skeleton (Japanese Laid-Open Patent Application 53-138229), an azo pigment having a triphenylamine skeleton (Japanese Laid-Open Patent Application 53-132547), an azo pigment having a dibenzothiophene skeleton (Japanese Laid-Open Patent Application 54-21728), an azo pigment having an oxadiàzole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), an azo pigment having a distyryl carbazole skeleton (Japanese Laid-Open Patent Application 54-17734), a triazo pigment having a carbazole skeleton (Japanese Laid-Open Patent Applications 57-195767 and 57-195768), a phthalocyanine pigment such as C.I. Pigment Blue 16 (C.I. 74100), an indigo pigment such as C.I. Vat Brown 5 (C.I. 73410) and C.I. Vat Dye (C.I. 73030), and a perylene pigment such as Algol Scarlet B and Indanthrene Scarlet R (made by Bayer Co., Ltd.).

Examples of the charge transporting material for use in the present invention are electron donor materials such as poly-N-vinyl carbazole and derivatives thereof, poly-γ-carbazolyl ethyl glutamate and derivatives thereof, a pyrene —formaldehyde condensation product and derivatives thereof, polyvinyl pyrene, polyvinyl phenanthrene, oxazole derivatives, oxadiazole derivatives, imidazole derivatives, triphenylamine derivatives, 9-(p-diethylaminostyryl)anthracene, 1,1-bis(4-dibenzylaminophenyl)propane, styrylanthracene, styrylpyrazoline, phenylhydrazone compounds and $\alpha^1$ phenylstilbene derivatives.

Examples of the binder agents for use in the charge generation layer, the charge transport layer and the dispersion-type photoconductive layer are polycarbonate (bisphenol A and bisphenol Z), polyester, methacrylic resin, acrylic resin, polyethylene, polyvinyl chloride, polyvinyl acetate, polystyrene, phenolic resin, epoxy resin, polyurethane, vinylidene chloride, alkyd resin, silicone resin, polyvinylcarbazole, polyvinyl butyral, polyvinyl formal, polyacrylate, polyacrylamide, polyamide and phenoxy resin. Those binder agents can be used alone or in combination.

In the negatively chargeable photoconductor, a charge generation layer is formed on a charge transport layer. In such a case, it is preferable that the amount ratio of the charge generating material to the binder agent in the charge generation layer be in the range of 20 to 500 wt. %. The thickness of the charge generation layer is preferably in the range of 0.1 to 5 μm. In addition, it is preferable that the amount ratio of the charge transporting material to the binder agent in the charge transport layer be in the range of 20 to 200 wt. %. The thickness of the charge transport layer is preferably in the range of 5 to 50 μm.

In the positively chargeable photoconductor, a charge transport layer is formed on a charge generation layer. In such a case, it is preferable that the amount ratio of the charge transporting material to the binder agent in the charge transport layer be in the range of 20 to 200 wt. %. The thickness of the charge transport layer is preferably in the range of 5 to 50 μm. In addition, it is preferable that the amount ratio of the charge generating material to the binder agent in the charge generation layer be in the range of 10 to 100 wt. %. The thickness of the charge generation layer is preferably in the range of 0.2 to 3 μm. Furthermore, as previously mentioned, it is preferable that the charge transporting material be contained in the charge generation layer to prevent the residual potential from increasing and to improve the sensitivity. In this case, it is preferable that the amount ratio of the charge transporting material to the binder agent in the charge generation layer be in the range of 20 to 200 wt. %.

Examples of the solvent or dispersion medium which is used in the formation of the charge generation layer and charge transport layer are N,N'-dimethylformamide, acetone, methyl ethyl ketone, cyclohexanone, benzene, toluene, xylene, chloroform, 1,2-dichloroethane, dichloromethane, monochlorobenzene and tetrahydrofuran.

To prepare the photoconductive layer, a coating solution for the charge generation layer or charge transport layer is coated on the electroconductive support by dip coating or spray coating.

For the electroconductive support for use in the electrophotographic photoconductor according to the present invention, a metallic drum or sheet made of aluminum, brass, stainless steel and nickel; or a sheet of polyethylene terephthalate, polypropylene, nylon or paper on which a metal such as aluminum and nickel is deposited; and a plastic film or a sheet of paper which has been treated so as to be electroconductive by coating thereon an electroconductive material such as titanium oxide, tin oxide and carbon black together with an appropriate binder agent, and it may be prepared in a cylindrical form.

In the present invention, a protective layer may be provided on the top layer to improve the resistance to abrasion and wear, thereby durability. In this case, conventionally known components for use in the protective layer can be employed.

In the present invention, the electrophotographic photoconductor may be prepared by successively forming a charge-injection controlling layer, a photoconductive layer and a protective layer on an electroconductive support in this order; or it may be prepared by successively forming a photoconductive layer, a charge-injection controlling layer and a protective layer on an electroconductive support.

Other features of this invention will become apparent in the course of the following description of exemplary embodiments, which are given for illustration of the invention and are not intended to be limiting thereof.

Preparation Example 1

A mixture of 10 g (0.068 mol) of acrylic anilide (Monomer No. 1 in Table 1), 30 g of ethanol and 0.1 g of azobisisobutyronitrile was placed in a four-necked flask. This reaction mixture was allowed to react at 62±1° C. in a stream of nitrogen for 3 hours and then refluxed at 70° C. for 2 hours for polymerization of the acrylic anilide, so that a milky white, highly viscous reaction product was obtained.

It was confirmed that the thus obtained reaction product was a homopolymer of Monomer No. 1 in Table 1.

Preparation Example 2

A mixture of 3 g of m-hydroxyacrylic anilide Monomer No. 15 in Table 1), 3.7 g of m-carboxyacrylic anilide (Monomer No. 11 in Table 1), 2.96 g of N-methylacrylic anilide (Monomer No. 28 in Table 1), 29 g of dimethylformamide and 0.089 g of azobisisobutyronitrile was placed in a 50-ml four-necked flask. This reaction mixture was allowed to react at 70° C. for 3 hours and then at 90° C. for 2 hours in a stream of nitrogen to complete the polymerization reaction.

After the completion of the polymerization reaction, the reaction solution was poured in 1 l of acetone, so that a white polymer was obtained. The thus obtained white polymer was separated from the reaction solution by filtration, washed with acetone, separated by filtration again, and dried under vacuum at 80° C. for 5 hours.

It was confirmed that the thus obtained polymer was a copolymer of Monomer No. 15—Monomer No. 11—Monomer No. 28.

EXAMPLE 1

Formation of Charge Transport Layer

A charge transport layer coating solution consisting of the following components was coated by blade coating on an aluminum-deposited polyethylene terephthalate film, serving as an electroconductive support, and dried at 120° C. for 20 minutes, so that a charge transport layer having a thickness of 22 μm was formed on the electroconductive support.

(Formulation of Charge Transport Layer Coating Solution)

| | Amount |
|---|---|
| 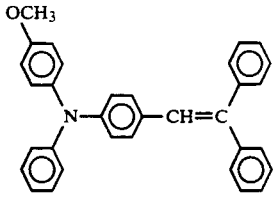 | 18 g |
| Commercially available polycarbonate "C-1400" (Trademark) made by Teijin Limited. | 20 g |
| Dichloromethane | 200 g |
| Commercially available silicone oil "KF-50" (Trademark) made by Shin-Etsu Chemical Co., Ltd. | 0.002 g |

Formation of Charge Generation Layer

A charge generation layer coating solution consisting of the following components was coated by spray coating on the above prepared charge transport layer and dried at 120° C. for 15 minutes, so that a charge generation layer having a thickness of 0.2 to 0.4 μm was formed on the charge transport layer.

(Formulation of Charge Generation Layer Coating Solution)

| | Amount |
|---|---|
| 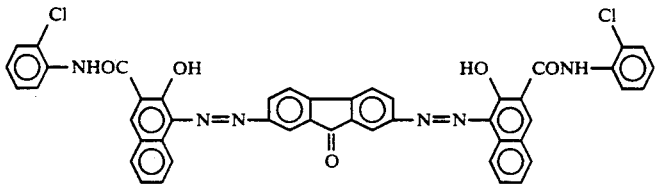 | 1 g |
| Cyclohexanone | 50 g |
| Methyl ethyl ketone | 50 g |

Formation of Charge-injection Controlling Layer

A solution of the homopolymer of Monomer No. 1 obtained in Preparation Example 1, which was dissolved in a mixed solvent of ethanol and butanol (weight ratio of 1:1) at a concentration of 1%, was coated on the above prepared charge generation layer by spray coating and dried at 120° C. for 10 minutes, so that a charge-injection controlling layer having a thickness of 0.5 μm was formed on the charge generation layer.

Formation of Protective Layer

A mixture of the following components was pulverized and dispersed in a ball mill for 72 hours. The thus obtained mixture was let down in methyl isobutyl ketone until a solid content of this solution attained to 2%.

| | Amount |
|---|---|
| Styrene - methyl methacrylate - 2-hydroxyethyl methacrylate copolymer (weight ratio of 3:5:2) (solubility parameter of 9.4 to 9.5) | 4 g |
| $SnO_x$ (made by Sumitomo Cement Co., Ltd.) | 6 g |
| Toluene | 30 g |
| Methyl ethyl ketone | 5 g |
| n-butanol | 5 g |

To the above solution, 3 g of commercially available isocyanate compound, "SUMIDUR HT", made by Sumitomo Bayer Urethane Co., Ltd., was added, so that a protective layer coating solution was obtained.

The thus obtained protective layer coating solution was coated on the above prepared charge-injection controlling layer by spray coating and dried at 130° C. for 30 minutes, so that a protective layer having a thickness of 4 μm was formed on the charge-injection controlling layer.

Thus, electrophotographic photoconductor No. 1 according to the present invention was prepared.

EXAMPLES 2 to 10

The procedure for preparation of electrophotographic photoconductor No. 1 in Example 1 was repeated except that the homopolymer of Monomer No. 1 in the formulation of the charge-injection controlling layer coating solution in Example 1 was replaced by the respective homopolymers of the monomers as listed in Table 2, so that electrophotographic photoconductors No. 2 to No. 10 according to the present invention were prepared.

COMPARATIVE EXAMPLE 1

The procedure for preparation of electrophotographic photoconductor No. 1 in Example 1 was repeated except that the formulation of the charge-injection controlling layer coating solution in Example 1 was replaced by the following formulation, so that comparative electrophotographic photoconductor No. 1 was prepared.

| | Amount |
|---|---|
| Commercially available polyamide resin "CM-8000" (Trademark) made by Toray Silicone Co., Ltd. | 1 g |
| Methanol | 50 g |
| n-butanol | 50 g |

COMPARATIVE EXAMPLE 2

The procedure for preparation of electrophotographic photoconductor No. 1 in Example 1 was repeated except that the formulation of the charge-injection controlling layer coating solution in Example 1 was replaced by a solution of a commercially available phenolic resin, "PLYOPHEN J-325" (Trademark), made by Dainippon Ink & Chemicals, Inc., which was dissolved in a mixed solvent of methanol and butanol until the solid content of this solution attained to 1 wt. %, so that comparative electrophotographic photoconductor No. 2 was prepared.

Using a commercially available electrostatic copying sheet testing apparatus, "Paper Analyzer Model SP-428", made by Kawaguchi Electro Works Co., Ltd., the electrophotographic characteristics of the electrophotographic photoconductors No. 1 to 10 according to the present invention and comparative electrophotographic photoconductors No. 1 and No. 2 were evaluated in a dynamic mode by the following method:

Each photoconductor was charged positively in the dark under application of +6 kV of corona charge for 20 seconds and the surface potential $V_m$ (V) of the photoconductor was measured. Each photoconductor was allowed to stand in the dark for 20 seconds without applying any charge thereto, and the surface potential $V_o$ (V) of the photoconductor was measured. The photoconductor was then illuminated by a tungsten lamp in such a manner that the illuminance on the illuminated surface of the photoconductor was 4.5 lux, and the exposure $E_{1/10}$ (lux·sec) required to reduce the initial surface potential $V_o$ to 1/10 the initial surface potential $V_o$ was measured. In addition, the surface potential $V_{30}$ (V) was measured after the photoconductor was exposed to the tungsten lamp for 30 seconds. The initial characteristics of $V_m$, $V_o$, $V_{30}$ and $E_{1/10}$ are shown in Table 2.

The fatigue characteristics of each photoconductor were then evaluated using a commercially available fatigue testing machine.

In the fatigue testing machine, each of the electrophotographic photoconductors was continuously exposed to light for 30 minutes in such a manner that the illuminance on the illuminated surface of the photoconductor was 45 lux, with the electric current flowing through the photoconductive layer adjusted to 9.6 $\mu$A. After the above continuous exposure to the light for 30 minutes, the quantity of electric charge flowing through the photoconductive layer amounted to about $5.24\times10^{-4}$ c/cm$^2$, which is equivalent to the one obtained when 2000 to 3000 copies are made by the normal copying process.

After the completion of the fatigue test, each photoconductor was returned to the commercially available electrostatic copying sheet testing apparatus, "Paper Analyzer Model SP-428", and $V_m$, $V_o$, $V_{30}$ and $E_{1/10}$ were measured under the same conditions as employed in the above. The thus obtained values of $V_m$, $V_o$, $V_{30}$ and $E_{1/10}$ are expressed as the fatigue characteristics in Table 2.

TABLE 2

| Example No. | Monomer No. in C-I. controlling Layer | | Vm | Vo | V30 | El/10 |
|---|---|---|---|---|---|---|
| 1 | No. 1 | Initial Characteristics | 1300 | 1120 | 10 | 1.31 |
| | | Fatigue Characteristics | 1320 | 1120 | 12 | 1.33 |
| 2 | No. 3 | Initial Characteristics | 1350 | 1170 | 13 | 1.51 |
| | | Fatigue Characteristics | 1370 | 1200 | 18 | 1.56 |
| 3 | No. 6 | Initial Characteristics | 1220 | 970 | 5 | 1.25 |
| | | Fatigue Characteristics | 1220 | 940 | 6 | 1.25 |
| 4 | No. 7 | Initial Characteristics | 1300 | 1010 | 11 | 1.48 |
| | | Fatigue Characteristics | 1340 | 1140 | 15 | 1.50 |
| 5 | No. 8 | Initial Characteristics | 1290 | 1150 | 10 | 1.30 |
| | | Fatigue Characteristics | 1250 | 1100 | 11 | 1.31 |
| 6 | No. 15 | Initial Characteristics | 1320 | 1150 | 5 | 1.18 |
| | | Fatigue Characteristics | 1290 | 1120 | 7 | 1.20 |
| 7 | No. 16 | Initial Characteristics | 1390 | 1110 | 14 | 1.35 |
| | | Fatigue Characteristics | 1410 | 1200 | 14 | 1.34 |
| 8 | No. 19 | Initial Characteristics | 1410 | 1130 | 10 | 1.46 |
| | | Fatigue Characteristics | 1480 | 1200 | 11 | 1.47 |
| 9 | No. 20 | Initial Charac- | 1320 | 1210 | 5 | 1.36 |

TABLE 2-continued

| Example No. | Monomer No. in C-I. controlling Layer | | Vm | Vo | V30 | El/10 |
|---|---|---|---|---|---|---|
| | | teristics | | | | |
| | | Fatigue Characteristics | 1300 | 1170 | 5 | 1.36 |
| 10 | No. 21 | Initial Characteristics | 1260 | 1080 | 7 | 1.28 |
| | | Fatigue Characteristics | 1230 | 1050 | 7 | 1.28 |
| Comp. Exam. 1 | Polyamide resin | Initial Characteristics | 1350 | 1180 | 5 | 1.38 |
| | | Fatigue Characteristics | 1120 | 750 | 15 | 2.14 |
| Comp. Exam. 2 | Phenolic resin | Initial Characteristics | 1410 | 1360 | 28 | 2.45 |
| | | Fatigue Characteristics | 1390 | 1290 | 88 | 3.88 |

EXAMPLE 11

The procedure for Example 1 was repeated except that the charge-injection controlling layer and the protective layer employed in Example 1 were respectively replaced by the following charge-injection controlling layer and the protective layer.

Formation of Charge-injection Controlling Layer

A solution of the copolymer of Monomer No. 15—Monomer No. 11—Monomer No. 28 obtained in Preparation Example 2, which was dissolved in a mixed solvent of ethanol and butanol (weight ratio of 1:1) at a concentration of 1%, was coated on the above prepared charge generation layer by spray coating and dried at 120° C. for 10 minutes, so that a charge-injection controlling layer having a thickness of 0.5 μm was formed on the charge generation layer.

Formation of Protective Layer

A mixture of the following components was dispersed in a ball mill for 48 hours. The thus obtained mixture was further dispersed with addition of 60 g of cyclohexanone thereto, so that a protective layer coating solution was obtained.

| (Formulation of Protective Layer Coating Solution) | |
|---|---|
| | Amount |
| Comercially available polycarbonate "PCX-5" (Trademark) made by Teijin Limited. | 5 g |
| Indium oxide (made by Mitsubishi Metal Corporation | 2 g |
| Tetrahydrofuran | 70 g |
| Cyclohexanone | 70 g |

The thus obtained protective layer coating solution was coated on the above prepared charge-injection controlling layer by spray coating and dried at 130° C. for 30 minutes, so that a protective layer having a thickness of 4 μm was formed on the charge-injection controlling layer.

Thus electrophotographic photoconductor No. 11 according to the present invention was prepared:

EXAMPLES 12 to 14

The procedure for preparation of electrophotographic photoconductor No. 11 employed in Example 11 was repeated except that the copolymer of Monomer No. 15—Monomer No. 11—Monomer No. 28 in the formulation of the charge-injection controlling layer coating solution employed in Example 11 was replaced by the copolymers of the respective monomers as shown in Table 3, so that electrophotographic photoconductors No. 12 to No. 14 according to the present invention were prepared.

The initial characteristics and fatigue characteristics of electrophotographic photoconductors No. 11 to No. 14 according to the present invention were evaluated in the same manner as in Example 1. The results are shown in Table 3.

TABLE 3

| Example No. | Monomer No. in C-I. Controlling Layer | | Vm | Vo | V30 | El/10 |
|---|---|---|---|---|---|---|
| 11 | No. 15/No. 11/ No. 28 (molar ratio of 1/1/1) | Initial Characteristics | 1450 | 1200 | 10 | 1.31 |
| | | Fatigue Characteristics | 1520 | 1280 | 10 | 1.35 |
| 12 | No. 15/No. 16 (molar ratio of 1/1) | Initial Characteristics | 1400 | 1120 | 11 | 1.30 |
| | | Fatigue Characteristics | 1480 | 1180 | 11 | 1.32 |
| 13 | No. 15/No. 11 (molar ratio of 1/1) | Initial Characteristics | 1380 | 1190 | 8 | 1.28 |
| | | Fatigue Characteristics | 1440 | 1200 | 9 | 1.31 |
| 14 | No. 16/No. 19 (molar ratio of 1/1) | Initial Characteristics | 1480 | 1220 | 15 | 1.46 |
| | | Fatigue Characteristics | 1510 | 1370 | 17 | 1.48 |

EXAMPLE 15

Formation of Charge Transport Layer

A charge transport layer coating solution consisting of the following components was coated by dip coating on the outer surface of an aluminum cylinder having a diameter of 80 mm and a length of 340 mm, serving as an electroconductive support, and dried at 120° C. for 20 minutes, so that a charge transport layer having a thickness of 22 μm was formed on the electroconductive support.

| (Formulation of Charge Transport Layer Coating Solution) | |
|---|---|
| | Amount |
| 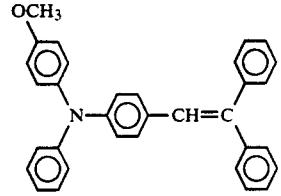 | 18 g |

-continued

| (Formulation of Charge Transport Layer Coating Solution) | Amount |
|---|---|
| Commercially available polycarbonate "C-1400" (Trademark) made by Teijin Limited. | 20 g |
| Dichloromethane | 200 g |
| Commercially available silicone oil "KF-50" (Trademark) made by Shin-Etsu Chemical Co., Ltd. | 0.002 g |

Formation of Charge Generation Layer

A charge generating layer coating solution of the following components was coated by spray coating on the above prepared charge transport layer and dried at 120° C. for 10 minutes, so that a charge generation layer having a thickness of 0.2 to 0.4 μm was formed on the charge transport layer.

| (Formulation of Charge Generation Layer Coating Solution) | Amount |
|---|---|
| 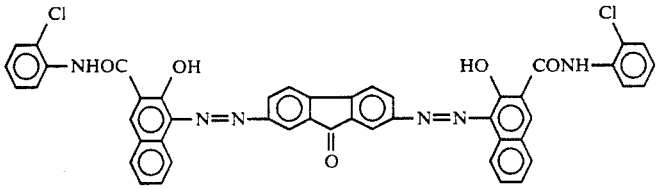 | 1 g |
| Cyclohexanone | 50 g |
| Methyl ethyl ketone | 50 g |

Formation of Charge-injection Controlling Layer

A solution of the homopolymer of Monomer No. 1 obtained in Preparation Example 1, which was dissolved in a mixed solvent of ethanol and butanol (weight ratio of 1:1) at a concentration of 1%, was coated on the above prepared charge generation layer by spray coating and dried at 120° C. for 10 minutes, so that a charge-injection controlling layer having a thickness of 0.5 μm was formed on the charge generation layer.

Formation of Protective Layer

A mixture of the following components was pulverized and dispersed in a ball mill for 72 hours. The thus obtained mixture was let down in methyl isobutyl ketone until the solid content of this solution attained to 2%.

| | Amount |
|---|---|
| Styrene - methyl methacrylate - 2-hydroxyethyl methacrylate copolymer (weight ratio of 3:5:2) (solubility parameter of 9.4 to 9.5) | 4 g |
| $SnO_x$ (made by Sumitomo Cement Co., Ltd.) | 6 g |
| Toluene | 30 g |
| Methyl ethyl ketone | 5 g |
| n-butanol | 5 g |

To this solution, 3 g of commercially available isocyanate compound, "SUMIDUR HT", made by Sumitomo Bayer Urethane Co., Ltd., was added, so that a protective layer coating solution was obtained.

The thus obtained protective layer coating solution was coated on the above prepared charge-injection controlling layer by spray coating and dried at 130° C. for 30 minutes, so that a protective layer having a thickness of 4 μm was formed on the charge-injection controlling layer.

Thus, electrophotographic photoconductor No. 15 according to the present invention was prepared.

EXAMPLES 16 to 20

The procedure for preparation of electrophotographic photoconductor No. 15 employed in Example 15 was repeated except that the homopolymer of Monomer No. 1 in the formulation of the charge-injection controlling layer coating solution in Example 15 was replaced by the respective homopolymers or copolymers of the monomers as listed in Table 4, so that electrophotographic photoconductors No. 16 to No. 20 according to the present invention were prepared.

COMPARATIVE EXAMPLE 3

The procedure for preparation of electrophotographic photoconductor No. 15 employed in Example 15 was repeated except that the formulation of the charge-injection controlling layer coating solution in Example 15 was replaced by the same formulation as employed in Comparative Example 1, so that comparative electrophotographic photoconductor No. 3 was prepared.

COMPARATIVE EXAMPLE 4

The procedure for preparation of electrophotographic photoconductor No. 15 employed in Example 15 was repeated except that the formulation of the charge-injection controlling layer coating solution in Example 15 was replaced by the same formulation as employed in Comparative Example 2, so that comparative electrophotographic photoconductor No. 4 was prepared.

Each of the thus prepared electrophotographic photoconductors No. 15 to No. 20 according to the present invention and comparative electrophotographic photoconductors No. 3 and No. 4 was incorporated in a commercially available copying machine, "FT-6550" (Trademark), made by Ricoh Company Ltd., and copying operations were conducted, with the environmental conditions of the temperature and humidity being changed as shown in Table 4. In the initial stage, charging and exposure conditions were adjusted so as to set the surface potential ($V_D$) of a portion not exposed to light (corresponding to an image area) at 800 V and the surface potential ($V_L$) of a portion exposed to light (corresponding to a non-image area) at 80 V.

The surface potentials ($V_D$) and ($V_L$) of the electrophotographic photoconductors were measured after making of 10,000 copies under the different conditions. The results are shown in Table 4.

Electrophotographic photoconductors No. 15 to No. 20 according to the present invention yielded clear images independently of the environmental conditions even after 10,000 copies were made. In the case of comparative electrophotographic photoconductors No. 3 and No. 4, on the other hand, clear images were obtained at 20° C. and 60% RH both at the initial stage and after making of 10,000 copies, but the deposition of toner particles was observed on the transfer sheet after making of 10,000 copies at 10° C. and 15% RH. In addition, breakages were observed in thin line images and images in their entirety became blurred after making of 10,000 copies at 30° C. and 90% RH.

TABLE 4

| Example No. | Monomer No. in Intermediate Layer | 10° C. 15% At initial stage $V_D$ | $V_L$ | 10° C. 15% After making of 10000 copies $V_D$ | $V_L$ | 20° C. 60% At initial stage $V_D$ | $V_L$ | 20° C. 60% After making of 10000 copies $V_D$ | $V_L$ | 30° C. 90% At initial stage $V_D$ | $V_L$ | 30° C. 90% After making of 10000 copies $V_D$ | $V_L$ |
|---|---|---|---|---|---|---|---|---|---|---|---|---|---|
| 15 | No. 1 | 800 | 80 | 780 | 85 | 800 | 80 | 800 | 80 | 800 | 80 | 810 | 80 |
| 16 | No. 8 | 800 | 80 | 810 | 86 | 800 | 80 | 805 | 84 | 800 | 80 | 800 | 79 |
| 17 | No. 15 | 800 | 80 | 830 | 90 | 800 | 80 | 810 | 85 | 800 | 80 | 790 | 75 |
| 18 | No. 15/No. 11 No. 28 (molar ratio of 1/1/1) | 800 | 80 | 810 | 85 | 800 | 80 | 800 | 85 | 800 | 80 | 790 | 80 |
| 19 | No. 15/No. 16 (molar ratio of 1/1) | 800 | 80 | 820 | 87 | 800 | 80 | 800 | 85 | 800 | 80 | 800 | 78 |
| 20 | No. 15/No. 1 (molar ratio of 1/1) | 800 | 80 | 820 | 85 | 800 | 80 | 800 | 85 | 800 | 80 | 780 | 75 |
| Comp. Exam. 3 | Polyamide resin | 800 | 80 | 880 | 120 | 800 | 80 | 790 | 100 | 800 | 80 | 700 | 60 |
| Comp. Exam. 4 | Phenolic resin | 800 | 80 | 880 | 140 | 800 | 80 | 790 | 110 | 800 | 80 | 750 | 80 |

EXAMPLE 21

Formation of Charge-injection Controlling Layer

A mixed solution of dimethylformamide (DMF) and methyl cellosolve (mixing ratio of 3:12) in which a homopolymer of Monomer No. 9 was dissolved at a concentration of 4% was coated by blade coating on an aluminum-deposited polystyrene terephthalate film, serving as an electroconductive support, and dried, so that a charge-injection controlling layer having a thickness of 0.5 μm was formed on the electroconductive support.

Formation of Charge Generation Layer

The same charge generation layer coating solution as employed in Example 1, with the following formulation, was coated on the above prepared charge-injection controlling layer by blade coating and dried at 120° C. for 15 minutes, so that a charge generation layer having a thickness of 0.2 μm was formed on the charge-injection controlling layer.

(Formulation of Charge Generation Layer Coating Solution)

| | Amount |
|---|---|
| 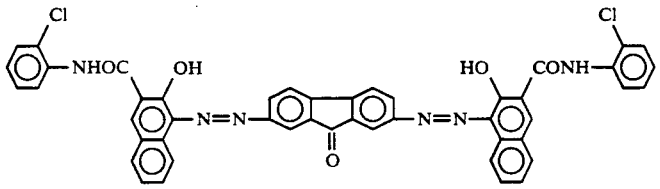 | 1 g |
| Cyclohexanone | 50 g |
| Methyl ethyl ketone | 50 g |

Formation of Charge Transport Layer

A charge transport layer coating solution consisting of the following components was coated on the above prepared charge generation layer by blade coating and dried, so that a charge transport layer having a thickness of 22 μm was formed on the charge generation layer.

(Formulation of Charge Transport Layer Coating Solution)

| | Amount |
|---|---|
| 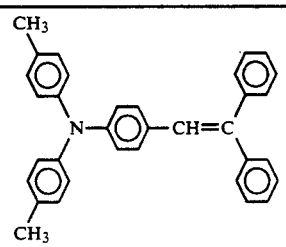 | 9 g |
| Commercially available | 10 g |

-continued

| (Formulation of Charge Transport Layer Coating Solution) | Amount |
|---|---|
| polycarbonate "PCX-5" (Trademark) made by Teijin Limited. | |
| Dichloromethane | 85 g |
| Commercially available silicone oil "KF-50" (Trademark) made by Shin-Etsu Chemical Co., Ltd. | 0.001 g |

Thus, electrophotographic photoconductor No. 21 according to the present invention was prepared.

EXAMPLES 22 to 27

The procedure for preparation of electrophotographic photoconductor No. 21 in Example 21 was repeated except that the homopolymer of Monomer No. 9 in the formulation of the charge-injection controlling layer coating solution in Example 21 was replaced by the respective homopolymers or copolymers of the monomers as listed in Table 5, so that electrophotographic photoconductors No. 21 to No. 27 according to the present invention were prepared.

COMPARATIVE EXAMPLE 5

The procedure for preparation of electrophotographic photoconductor No. 21 in Example 21 was repeated except that the formulation of the charge-injection controlling layer coating solution in Example 21 was replaced by the same formulation as employed in Comparative Example 1, so that comparative electrophotographic photoconductor No. 5 was prepared.

COMPARATIVE EXAMPLE 6

The procedure for preparation of electrophotographic photoconductor No. 21 in Example 21 was repeated except that the formulation of the charge-injection controlling layer coating solution in Example 21 was replaced by the same formulation as employed in Comparative Example 2, so that comparative electrophotographic photoconductor No. 6 was prepared.

The initial characteristics and fatigue characteristics of electrophotographic photoconductors No. 21 to No. 27 according to the present invention and comparative electrophotographic photoconductors No. 5 and No. 6 were measured in the same manner as employed in Example 1.

In this case, the above electrophotographic photoconductors were charged negatively in the dark under application of −6 kV of corona charge for 20 seconds, using the same electrostatic copying sheet testing apparatus, "Paper Analyzer Model SP-428" (Trademark), made by Kawaguchi Electro Works Co., Ltd., as employed in Example 1.

Furthermore, the initial characteristics and fatigue characteristics depending on environmental conditions were evaluated with the temperature and humidity being changed as shown in Table 5.

The results are shown in Table 5.

TABLE 5

| Example No. | Monomer No. in Intermediate Layer | 10° C. 15% | | | | | | | | 20° C. 60% | | | | | | | |
|---|---|---|---|---|---|---|---|---|---|---|---|---|---|---|---|---|---|
| | | Initial Characteristics | | | | Fatigue Characteristics | | | | Initial Characteristics | | | | Fatigue Characteristics | | | |
| | | $V_m$ | $V_o$ | $V_{30}$ | El/10 | $V_m$ | $V_o$ | $V_{30}$ | El/10 | $V_m$ | $V_o$ | $V_{30}$ | El/10 | $V_m$ | $V_o$ | $V_{30}$ | El/10 |
| 21 | No. 9 | 1450 | 1370 | 3 | 1.62 | 1480 | 1400 | 4 | 1.64 | 1420 | 1350 | 2 | 1.60 | 1400 | 1320 | 3 | 1.59 |
| 22 | No. 11 | 1280 | 1150 | 0 | 1.28 | 1250 | 1080 | 0 | 1.23 | 1310 | 1180 | 0 | 1.20 | 1330 | 1050 | 0 | 1.18 |
| 23 | No. 14 | 1480 | 1370 | 5 | 1.78 | 1490 | 1410 | 7 | 1.81 | 1400 | 1290 | 6 | 1.70 | 1450 | 1310 | 7 | 1.75 |
| 24 | No. 21 | 1360 | 1180 | 0 | 1.36 | 1380 | 1080 | 0 | 1.37 | 1320 | 1200 | 0 | 1.34 | 1350 | 1200 | 0 | 1.35 |
| 25 | No. 6/No. 15 (molar ratio of 1/2) | 1370 | 1180 | 2 | 1.43 | 1390 | 1210 | 4 | 1.47 | 1400 | 1210 | 1 | 1.40 | 1450 | 1230 | 2 | 1.41 |
| 26 | No. 18/No. 6/No. 5 (molar ratio of 1/2/1) | 1480 | 1200 | 3 | 1.60 | 1500 | 1230 | 5 | 1.65 | 1410 | 1200 | 3 | 1.58 | 1440 | 1250 | 5 | 1.61 |
| 27 | No. 16/No. 11/No. 15 (molar ratio of 1/2/1) | 1300 | 1100 | 0 | 1.35 | 1320 | 1120 | 0 | 1.36 | 1310 | 1130 | 0 | 1.37 | 1350 | 1160 | 0 | 1.41 |
| Comp. Exam. 5 | Polyamide resin | 1420 | 1280 | 20 | 1.41 | 1510 | 1330 | 80 | 2.05 | 1280 | 1050 | 5 | 1.28 | 1390 | 1200 | 53 | 1.87 |
| Comp. Exam. 6 | Phenolic resin | 1580 | 1370 | 40 | 2.53 | 1670 | 1510 | 125 | 3.86 | 1440 | 1210 | 25 | 2.06 | 1440 | 1280 | 86 | 3.10 |

| Example No. | Monomer No. in Intermediate Layer | 30° C. 90% | | | | | | | |
|---|---|---|---|---|---|---|---|---|---|
| | | Initial Characteristics | | | | Fatigue Characteristics | | | |
| | | $V_m$ | $V_o$ | $V_{30}$ | El/10 | $V_m$ | $V_o$ | $V_{30}$ | El/10 |
| 21 | No. 9 | 1410 | 1320 | 0 | 1.58 | 1390 | 1290 | 0 | 1.56 |
| 22 | No. 11 | 1300 | 1090 | 0 | 1.18 | 1280 | 1000 | 0 | 1.18 |
| 23 | No. 14 | 1400 | 1200 | 0 | 1.68 | 1420 | 1220 | 0 | 1.70 |
| 24 | No. 21 | 1310 | 1100 | 0 | 1.32 | 1300 | 1050 | 0 | 1.30 |
| 25 | No. 6/No. 15 (molar ratio of 1/2) | 1320 | 1000 | 0 | 1.40 | 1300 | 980 | 3 | 1.43 |
| 26 | No. 18/No. 6/No. 5 (molar ratio of 1/2/1) | 1400 | 1150 | 4 | 1.59 | 1420 | 1190 | 6 | 1.61 |
| 27 | No. 16/No. 11/No. 15 (molar ratio | 1280 | 1080 | 0 | 1.33 | 1250 | 990 | 1 | 1.35 |

TABLE 5-continued

| | | | | | | | | | |
|---|---|---|---|---|---|---|---|---|---|
| | of 1/2/1) | | | | | | | | |
| Comp. Exam. 5 | Polyamide resin | 1120 | 880 | 0 | 1.53 | 1000 | 650 | 20 | 2.35 |
| Comp. Exam. 6 | Phenolic resin | 1200 | 850 | 0 | 2.00 | 980 | 770 | 80 | 4.23 |

What is claimed is:

1. An electrophotographic photoconductor comprising a photoconductive layer and a charge-injection controlling layer, which are formed on an electroconductive support, said charge-injection controlling layer comprising a homopolymer or copolymer of a monomer represented by formula (I):

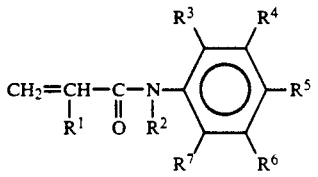

(I)

wherein $R^1$ represents hydrogen or a methyl group; $R^2$ represents hydrogen, an alkyl group having 1 to 4 carbon atoms, a hydroxyalkyl group having 1 to 4 carbon atoms, an aryl group which may have a substituent and an aralkyl group which may have a substituent; and $R^3$, $R^4$, $R^5$, $R^6$ and $R^7$ each represent hydrogen, an alkyl group having 1 to 4 carbon atoms, an alkoxyl group having 1 to 4 carbon atoms, a hydroxyl group, a nitro group, a nitroso group, a cyano group, a carboxyl group, an alkoxylcarbonyl group, an acyl group, a sulfonyl group, an amino group which may have a substituent, a halogen or a trifluoromethyl group.

2. The electrophotographic photoconductor as claimed in claim 1, wherein said charge-injection controlling layer is formed on said photoconductive layer.

3. The electrophotographic photoconductor as claimed in claim 1, wherein said photoconductive layer is formed on said charge-injection controlling layer.

4. The electrophotographic photoconductor as claimed in claim 1, wherein said charge-injection controlling layer has a thickness of 0.05 μm to 10 μm.

5. The electrophotographic photoconductor as claimed in claim 1, wherein said charge-injection controlling layer further comprises a resin selected from the group consisting of thermoplastic resins, thermosetting resins and photo-setting resins.

6. The electrophotographic photoconductor as claimed in claim 1, wherein said charge-injection controlling layer further comprises an electroconductive material selected from the group consisting of $SnO_2$ and $Sb_2O_3$ in the form of finely-divided particles.

7. The electrophotographic photoconductor as claimed in claim 1, wherein said charge-injection controlling layer further comprises a white pigment selected from the group consisting of ZnO, ZnS and $TiO_2$.

8. The electrophotographic photoconductor as claimed in claim 1, wherein said photoconductive layer comprises a charge generating material, a charge transporting material and a binder agent in which said charge generating material and said charge transporting material are dispersed.

9. The electrophotographic photoconductor as claimed in claim 1, wherein said photoconductive layer comprises (i) a charge generation layer comprising a charge generating material and a binder agent and [ii) a charge transport layer formed on said charge generation layer, comprising a charge transporting material and a binder agent.

10. The electrophotographic photoconductor as claimed in claim 1, wherein said photoconductive layer comprises (i) a charge transport layer comprising a charge transporting material and a binder agent and (ii) a charge generation layer formed on said charge transport layer, comprising a charge generating material and a binder agent.

11. The electrophotographic photoconductor as claimed in claim 9, wherein said charge generation layer has a thickness of 0.1 μm to 5 μm.

12. The electrophotographic photoconductor as claimed in claim 9, wherein said charge transport layer has a thickness of 5 μm to 50 μm.

13. The electrophotographic photoconductor as claimed in claim 9, wherein the amount ratio of said charge generating material to said binder agent in said charge generation layer is in the range of 20 to 500 wt. %.

14. The electrophotographic photoconductor as claimed in claim 9, wherein the amount ratio of said charge transporting material to said binder agent in said charge transport layer is in the range of 20 to 200 wt. %.

15. The electrophotographic photoconductor as claimed in claim 10, wherein said charge transport layer has a thickness of 5 μm to 50 μm.

16. The electrophotographic photoconductor as claimed in claim 10, wherein said charge generation layer has a thickness of 0.2 μm to 3 μm.

17. The electrophotographic photoconductor as claimed in claim 10, wherein the amount ratio of said charge transporting material to said binder agent in said charge transport layer is in the range of 20 to 200 wt. %.

18. The electrophotographic photoconductor as claimed in claim 10, wherein the amount ratio of said charge generating material to said binder agent in said charge generation layer is in the range of 10 to 100 wt. %.

19. The electrophotographic photoconductor as claimed in claim 10, wherein said charge generation layer further comprising a charge transporting material.

20. The electrophotographic photoconductor as claimed in claim 19, wherein the amount ratio of said charge transporting material to said binder agent in said charge generation layer is in the range of 20 to 200 wt. %.

21. The electrophotographic photoconductor as claimed n claim 1, further comprising a protective layer which is provided on the uppermost layer of said photoconductive layer or said charge-injection controlling layer.

* * * * *

UNITED STATES PATENT AND TRADEMARK OFFICE

CERTIFICATE OF CORRECTION

PATENT NO. : 5,153,087

DATED : Oct. 6, 1992

INVENTOR(S) : Hiroshi Tamura, et al

It is certified that error appears in the above-indentified patent and that said Letters Patent is hereby corrected as shown below:

In the Abstract, line 2, after "comprises", insert --at--.

Column 3, line 17, after "$R^6$ and", insert --$R^7$--.

Column 26, Claim 9, line 11, change "[ii)" to --(ii)--;
Claim 19, line 54, change "comprising" to --comprises--;
Claim 21, line 61, after "claimed", delete "n", insert --in--.

Signed and Sealed this

Twelfth Day of April, 1994

Bruce Lehman

BRUCE LEHMAN

*Commissioner of Patents and Trademarks*

*Attest:*

*Attesting Officer*